US007181403B2

(12) United States Patent
Wu et al.

(10) Patent No.: US 7,181,403 B2
(45) Date of Patent: Feb. 20, 2007

(54) METHOD AND SYSTEM FOR REDUCTION OF QUANTIZATION-INDUCED BLOCK-DISCONTINUITIES AND GENERAL PURPOSE AUDIO CODEC

(75) Inventors: Shuwun Wu, Foothill Ranch, CA (US); John Mantegna, Irvine, CA (US); Keren Perlmutter, Newport Beach, CA (US)

(73) Assignee: America Online, Inc., Dulles, VA (US)

( * ) Notice: Subject to any disclaimer, the term of this patent is extended or adjusted under 35 U.S.C. 154(b) by 3 days.

(21) Appl. No.: 11/075,440

(22) Filed: Mar. 9, 2005

(65) Prior Publication Data

US 2005/0159940 A1 Jul. 21, 2005

Related U.S. Application Data

(62) Division of application No. 10/061,310, filed on Feb. 4, 2002, now Pat. No. 6,885,993, which is a division of application No. 09/321,488, filed on May 27, 1999, now Pat. No. 6,370,502.

(51) Int. Cl.
*G10L 21/00* (2006.01)

(52) U.S. Cl. ..... 704/500

(58) Field of Classification Search ..... None
See application file for complete search history.

(56) References Cited

U.S. PATENT DOCUMENTS 5,388,181 A 2/1995 Anderson et al.
5,428,395 A 6/1995 Jeong
5,787,204 A 7/1998 Fukuda
5,911,130 A 6/1999 Shimizu et al.

(Continued)

FOREIGN PATENT DOCUMENTS

EP 0 910 067 4/1999

(Continued)

OTHER PUBLICATIONS

Boden, A. F., Quantization Distortion in Block Transform-Compressed Data, Processings—DCC '95 Data Compression Conference, No. 28.3.1995, p. 427 (Mar. 30, 1995) (XP-002301642).

(Continued)

*Primary Examiner*—Susan McFadden
(74) *Attorney, Agent, or Firm*—Fish & Richardson P.C.

(57) ABSTRACT

Compressing the digitized time-domain continuous input signal typically includes formatting the input signal into a plurality of time-domain blocks having boundaries, forming an overlapping time-domain block by prepending a fraction of a previous time-domain block to a current time-domain block, transforming each overlapping time-domain block to a transform domain block including a plurality of coefficients, partitioning the coefficients of each transform domain block into signal coefficients and residue coefficients, quantizing the signal coefficients for each transformed domain block and generating signal quantization indices indicative of such quantization, modeling the residue coefficients for each transform domain block as stochastic noise and generating residue quantization indices indicative of such quantization, and formatting the signal quantization indices and the residue quantization indices for each transform domain block as an output bit-stream. The continuous data may include audio data.

36 Claims, 6 Drawing Sheets

U.S. PATENT DOCUMENTS

| | | | | |
|---|---|---|---|---|
| 5,987,407 | A | 11/1999 | Wu et al. | |
| 6,006,179 | A | 12/1999 | Wu et al. | |
| 6,256,422 | B1 | 7/2001 | Mitchell et al. | |
| 6,263,312 | B1 | 7/2001 | Kolesnik et al. | |
| 6,370,502 | B1 | 4/2002 | Wu et al. | |
| 6,475,245 | B2 | 11/2002 | Gersho et al. | |
| 6,704,706 | B2 | 3/2004 | Wu et al. | |
| 6,885,993 | B2 * | 4/2005 | Wu et al. | 704/500 |

FOREIGN PATENT DOCUMENTS

| | | |
|---|---|---|
| JP | 08-330971 | 12/1996 |
| WO | WO 99/22365 | 5/1999 |

OTHER PUBLICATIONS

International Preliminary Examination Report dated Feb. 21, 2001 (9 pages).

Lu et al.; "Adaptive cosine transform coding using marginal analysis"; *SPIE* vol. 2488; pp. 162-166; Apr. 1995; XP000938051.

Morhac et al., "Multidimensional Data Compression Using a New Fast Adaptive Cosine Transform," Applied Signal Processing, vol. 4, No. 1, pp. 16-26 (1997) (XP-000938172).

Ngan et al.; "A HVS-weighted cosine transform coding scheme with adaptive quantization"; *SPIE* vol. 1001 Visual Communications and Image Processing '88; pp. 702-708; Nov. 1988.

O'Shaughnessy, Douglas, "Windowing", *Speech Communication, Human and Machine,* pp. E06-E07, Jan. 1990.

PCT International Search Report dated Sep. 9, 2000.

Taswell, Carl, "Speech Compression with Cosine and Wavelet Packet Near-Best Bases," 1996 IEEE International Conference on Acoustics, Speech, and Signal Processing Conference Proceedings, vol. 1, pp. 566-568 (May 7, 1996) (XP-002301643).

* cited by examiner

FIG. 2: Audio Encoder
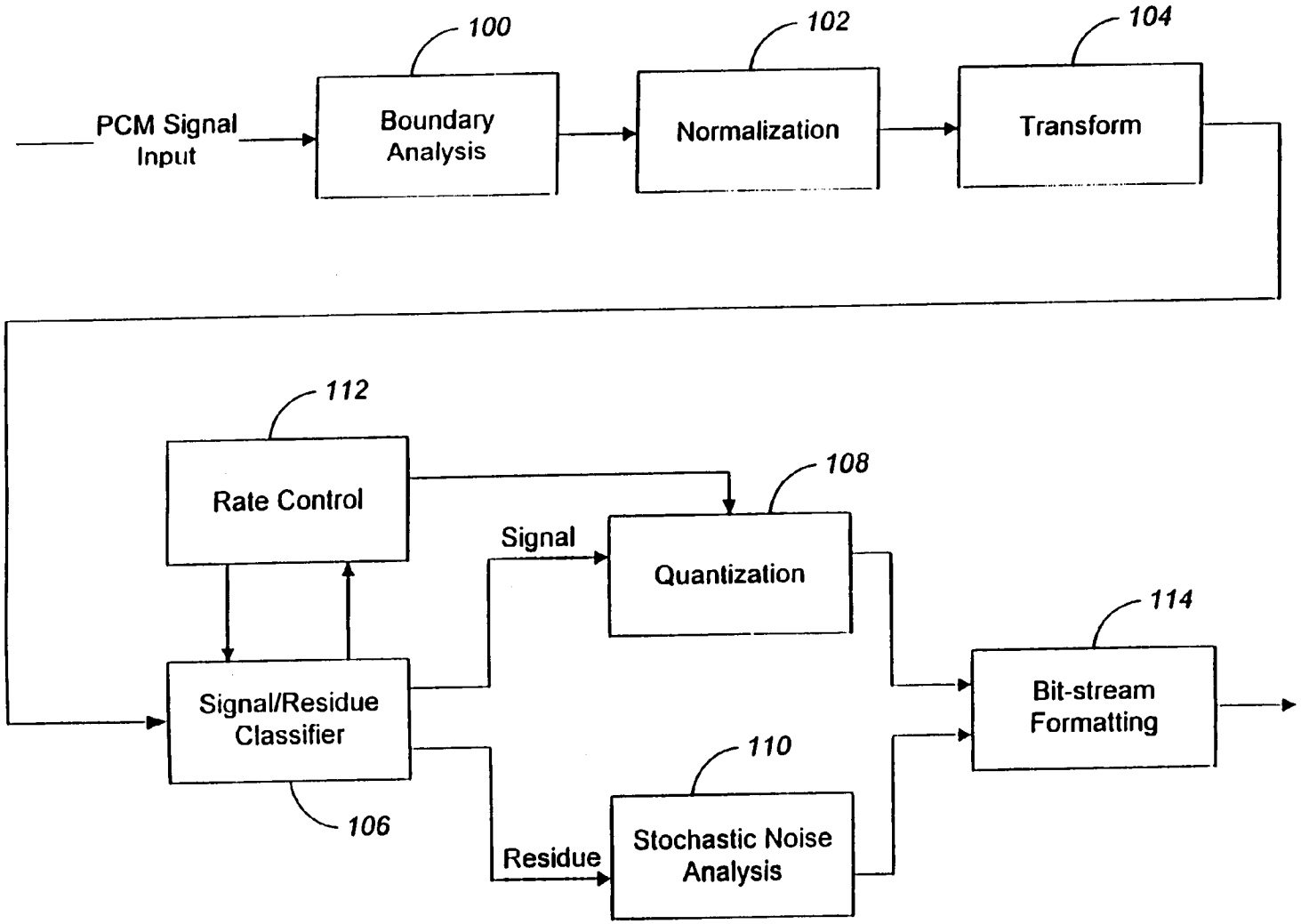

FIG. 3: Audio Decoder
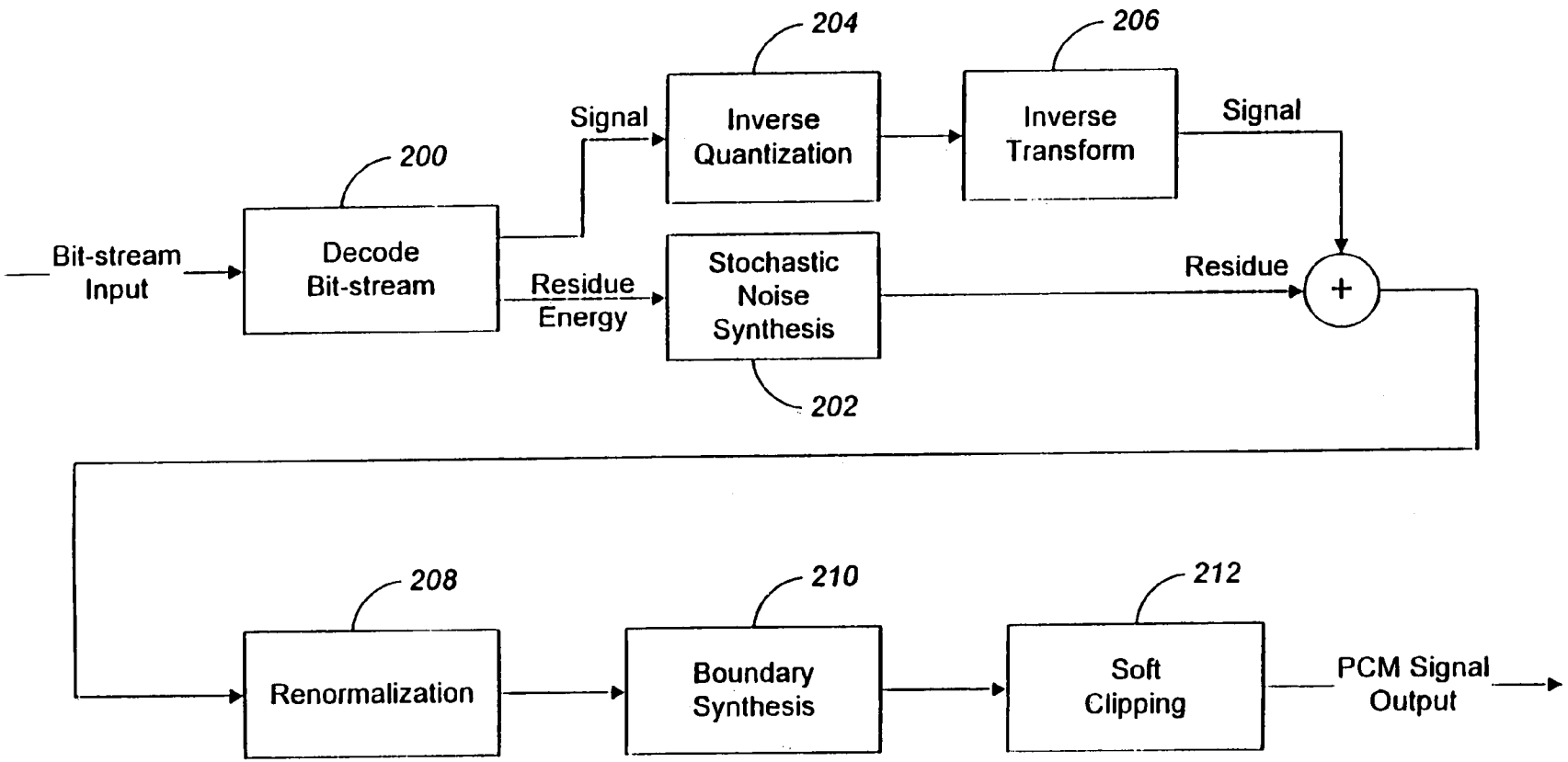

METHOD AND SYSTEM FOR REDUCTION OF QUANTIZATION-INDUCED BLOCK-DISCONTINUITIES AND GENERAL PURPOSE AUDIO CODEC

CROSS REFERENCE TO RELATED APPLICATIONS

This application is a divisional application of U.S. application Ser. No. 10/061,310, filed Feb. 4, 2002, now U.S. Pat. No. 6,885,993, which is a divisional of U.S. Ser. No. 09/321,488, filed May 27, 1999, now U.S. Patent No. 6,370,502, both of which are incorporated by reference.

TECHNICAL FIELD

This invention relates to compression and decompression of continuous signals, and more particularly to a method and system for reduction of quantization-induced block-discontinuities arising from lossy compression and decompression of continuous signals, especially audio signals.

BACKGROUND

A variety of audio compression techniques have been developed to transmit audio signals in constrained bandwidth channels and store such signals on media with limited storage capacity. For general purpose audio compression, no assumptions can be made about the source or characteristics of the sound. Thus, compression/decompression algorithms must be general enough to deal with the arbitrary nature of audio signals, which in turn poses a substantial constraint on viable approaches. In this document, the term "audio" refers to a signal that can be any sound in general, such as music of any type, speech, and a mixture of music and speech. General audio compression thus differs from speech coding in one significant aspect: in speech coding where the source is known a priori, model-based algorithms are practical.

Most approaches to audio compression can be broadly divided into two major categories: time and transform domain quantization. The characteristics of the transform domain are defined by the reversible transformations employed. When a transform such as the fast Fourier transform (FFT), discrete cosine transform (DCT), or modified discrete cosine transform (MDCT) is used, the transform domain is equivalent to the frequency domain. When transforms like wavelet transform (WT) or packet transform (PT) are used, the transform domain represents a mixture of time and frequency information.

Quantization is one of the most common and direct techniques to achieve data compression. There are two basic quantization types: scalar and vector. Scalar quantization encodes data points individually, while vector quantization groups input data into vectors, each of which is encoded as a whole. Vector quantization typically searches a codebook (a collection of vectors) for the closest match to an input vector, yielding an output index. A dequantizer simply performs a table lookup in an identical codebook to reconstruct the original vector. Other approaches that do not involve codebooks are known, such as closed form solutions.

A coder/decoder ("codec") that complies with the MPEG-Audio standard (ISO/IEC 11172-3; 1993(E))(here, simply "MPEG")is an example of an approach employing time-domain scalar quantization. In particular, MPEG employs scalar quantization of the time-domain signal in individual subbands, while bit allocation in the scalar quantizer is based on a psychoacoustic model, which is implemented separately in the frequency domain (dual-path approach).

It is well known that scalar quantization is not optimal with respect to rate/distortion tradeoffs. Scalar quantization cannot exploit correlations among adjacent data points and thus scalar quantization generally yields higher distortion levels for a given bit rate. To reduce distortion, more bits must be used. Thus, time-domain scalar quantization limits the degree of compression, resulting in higher bit-rates.

Vector quantization schemes usually can achieve far better compression ratios than scalar quantization at a given distortion level. However, the human auditory system is sensitive to the distortion associated with zeroing even a single time-domain sample. This phenomenon makes direct application of traditional vector quantization techniques on a time-domain audio signal an unattractive proposition, since vector quantization at the rate of 1 bit per sample or lower often leads to zeroing of some vector components (that is, time-domain samples).

These limitations of time-domain-based approaches may lead one to conclude that a frequency domain-based (or more generally, a transform domain-based) approach may be a better alternative in the context of vector quantization for audio compression. However, there is a significant difficulty that needs to be resolved in non-time-domain quantization based audio compression. The input signal is continuous, with no practical limits on the total time duration. It is thus necessary to encode the audio signal in a piecewise manner. Each piece is called an audio encode or decode block or frame. Performing quantization in the frequency domain on a per frame basis generally leads to discontinuities at the frame boundaries. Such discontinuities yield objectionable audible artifacts ("clicks" and "pops"). One remedy to this discontinuity problem is to use overlapped frames, which results in proportionately lower compression ratios and higher computational complexity. A more popular approach is to use critically sampled subband filter banks, which employ a history buffer that maintains continuity at frame boundaries, but at a cost of latency in the codec-reconstructed audio signal. The long history buffer may also lead to inferior reconstructed transient response, resulting in audible artifacts. Another class of approaches enforces boundary conditions as constraints in audio encode and decode processes. The formal and rigorous mathematical treatments of the boundary condition constraint-based approaches generally involve intensive computation, which tends to be impractical for real-time applications.

The inventors have determined that it would be desirable to provide an audio compression technique suitable for real-time applications while having reduced computational complexity. The technique should provide low bit-rate full bandwidth compression (about 1-bit per sample) of music and speech, while being applicable to higher bit-rate audio compression. The present invention provides such a technique.

SUMMARY

The invention includes a method and system for minimization of quantization-induced block-discontinuities arising from lossy compression and decompression of continuous signals, especially audio signals. In one embodiment, the invention includes a general purpose, ultra-low latency audio codec algorithm.

In one aspect, the invention includes: a method and apparatus for compression and decompression of audio signals using a novel boundary analysis and synthesis framework to substantially reduce quantization-induced frame or block-discontinuity; a novel adaptive cosine packet transform (ACPT) as the transform of choice to effectively capture the input audio characteristics; a signal-residue classifier to separate the strong signal clusters from the noise and weak signal components (collectively called residue); an adaptive sparse vector quantization (ASVQ) algorithm for signal components; a stochastic noise model for the residue; and an associated rate control algorithm. This invention also involves a general purpose framework that substantially reduces the quantization-induced block-discontinuity in lossy data compression involving any continuous data.

The ACPT algorithm dynamically adapts to the instantaneous changes in the audio signal from frame to frame, resulting in efficient signal modeling that leads to a high degree of data compression. Subsequently, a signal/residue classifier is employed to separate the strong signal clusters from the residue. The signal clusters are encoded as a special type of adaptive sparse vector quantization. The residue is modeled and encoded as bands of stochastic noise.

More particularly, in one aspect, the invention includes a zero-latency method for reducing quantization-induced block-discontinuities of continuous data formatted into a plurality of time-domain blocks having boundaries, including performing a first quantization of each block and generating first quantization indices indicative of such first quantization; determining a quantization error for each block; performing a second quantization of any quantization error arising near the boundaries of each block from such first quantization and generating second quantization indices indicative of such second quantization; and encoding the first and second quantization indices and formatting such encoded indices as an output bit-stream.

In another aspect, the invention includes a low-latency method for reducing quantization-induced block-discontinuities of continuous data formatted into a plurality of time-domain blocks having boundaries, including forming an overlapping time-domain block by prepending a small fraction of a previous time-domain block to a current time-domain block; performing a reversible transform on each overlapping time-domain block, so as to yield energy concentration in the transform domain; quantizing each reversibly transformed block and generating quantization indices indicative of such quantization; encoding the quantization indices for each quantized block as an encoded block, and outputting each encoded block as a bit-stream; decoding each encoded block into quantization indices; generating a quantized transform-domain block from the quantization indices; inversely transforming each quantized transform-domain block into an overlapping time-domain block; excluding data from regions near the boundary of each overlapping time-domain block and reconstructing an initial output data block from the remaining data of such overlapping time-domain block; interpolating boundary data between adjacent overlapping time-domain blocks; and prepending the interpolated boundary data with the initial output data block to generate a final output data block.

The invention also includes corresponding methods for decompressing a bitstream representing an input signal compressed in this manner, particularly audio data. The invention further includes corresponding computer program implementations of these and other algorithms.

Advantages of the invention include:

- A novel block-discontinuity minimization framework that allows for flexible and dynamic signal or data modeling;
- A general purpose and highly scalable audio compression technique;
- High data compression ratio/lower bit-rate, characteristics well suited for applications like real-time or non-real-time audio transmission over the Internet with limited connection bandwidth;
- Ultra-low to zero coding latency, ideal for interactive real-time applications;
- Ultra-low bit-rate compression of certain types of audio;
- Low computational complexity.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 1A shows a sine wave before quantization. FIG. 1B shows the sine wave of FIG. 1A after quantization. FIG. 1C shows that the quantization error or residue (and thus energy concentration) substantially increases near the boundaries of the block.

FIG. 2 is a block diagram of a preferred general purpose audio encoding system in accordance with the invention.

FIG. 3 is a block diagram of a preferred general purpose audio decoding system in accordance with the invention.

Like reference numbers and designations in the various drawings indicate like elements.

DETAILED DESCRIPTION

General Concepts

The following subsections describe basic concepts on which the invention is based, and characteristics of the preferred embodiment.

Framework for Reduction of Quantization-Induced Block-Discontinuity. When encoding a continuous signal in a frame or block-wise manner in a transform domain, block-independent application of lossy quantization of the transform coefficients will result in discontinuity at the block boundary. This problem is closely related to the so-called "Gibbs leakage" problem. Consider the case where the quantization applied in each data block is to reconstruct the original signal waveform, in contrast to quantization that reproduces the original signal characteristics, such as its frequency content. We define the quantization error, or "residue", in a data block to be the original signal minus the reconstructed signal. If the quantization in question is lossless, then the residue is zero for each block, and no discontinuity results (we always assume the original signal is continuous). However, in the case of lossy quantization, the residue is non-zero, and due to the block-independent application of the quantization, the residue will not match at the block boundaries: hence, block-discontinuity will result in the reconstructed signal. If the quantization error is relatively small when compared to the original signal strength. i.e., the reconstructed waveform approximates the original signal within a data block, one interesting phenomenon arises: the residue energy tends to concentrate at both ends of the block boundary. In other words, the Gibbs leakage energy tends to concentrate at the block boundaries. Certain windowing techniques can further enhance such residue energy concentration.

Figure 1A:
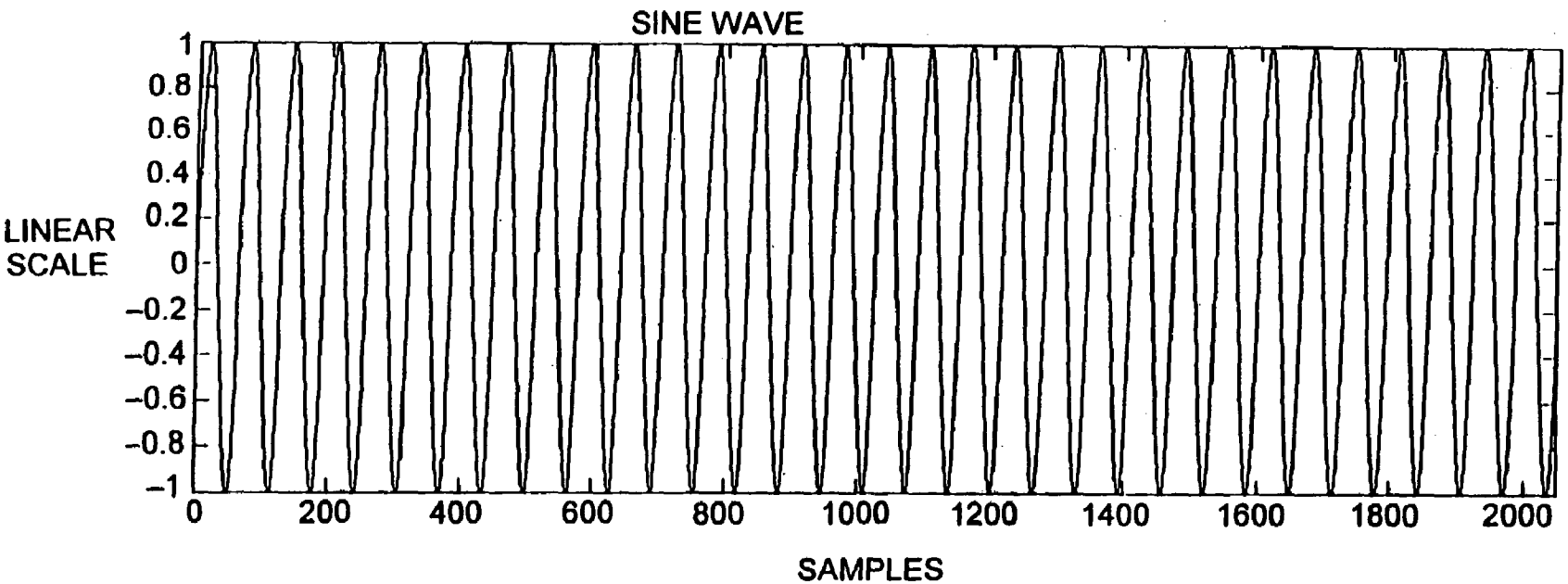
FIGS. 1A–1C are waveform diagrams for a data block derived from a continuous data stream.
Figure 1B:
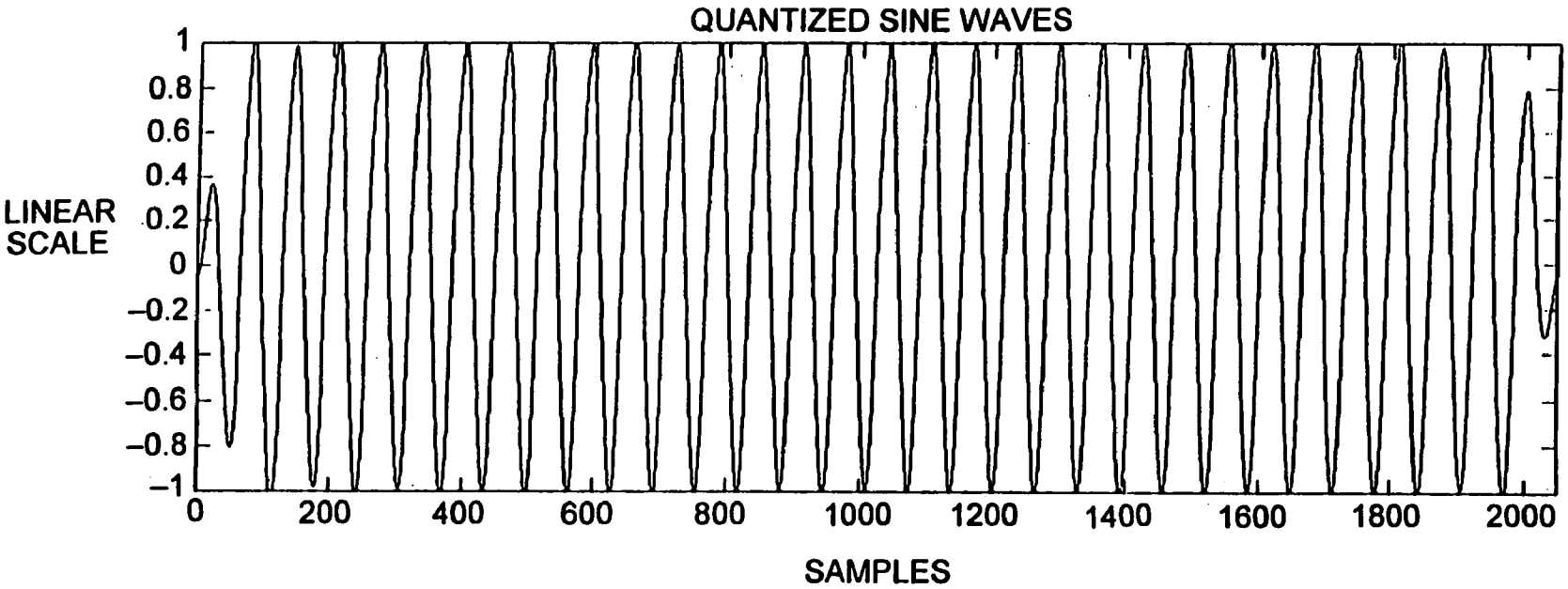
Figure 1C:
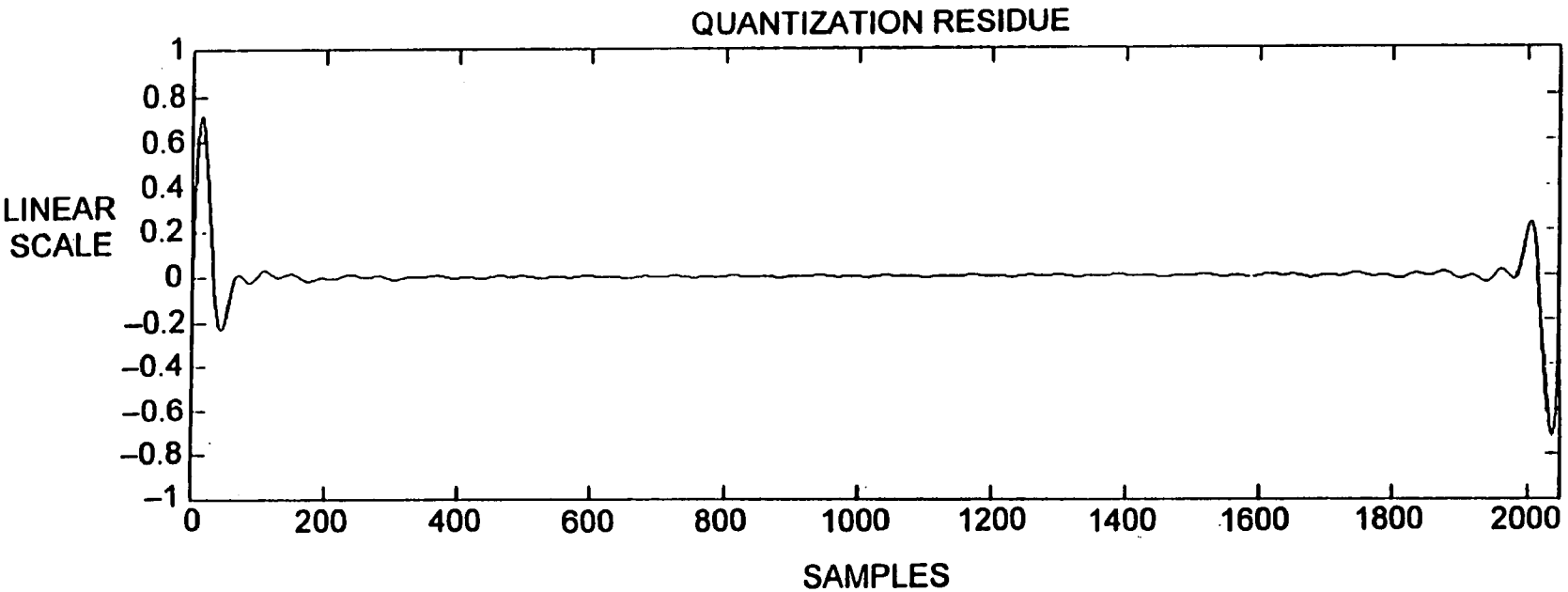

As an example of Gibbs leakage energy, FIGS. 1A–1C are waveform diagrams for a data block derived from a continuous data stream. FIG. 1A shows a sine wave before quantization. FIG. 1B shows the sine wave of FIG. 1A after quantization. FIG. 1C shows that the quantization error or residue (and thus energy concentration) substantially increases near the boundaries of the block.

With this concept in mind, one aspect of the invention encompasses:

1. Optional use of a windowing technique to enhance the residue energy concentration near the block boundaries. Preferred is a windowing function characterized by the identity function (i.e., no transformation) for most of a block, but with bell-shaped decays near the boundaries of a block (see FIG. 4, described below).
2. Use of dynamically adapted signal modeling to effectively capture the signal characteristics within each block without regard to neighboring blocks.
3. Efficient quantization on the transform coefficients to approximate the original waveform.
4. Use of one of two approaches near the block boundaries, where the residue energy is concentrated, to substantially reduce the effects of quantization error:
   (1) Residue quantization: Application of rigorous time-domain waveform quantization of the residue (i.e., the quantization error near the boundaries of each frame). In essence, more bits are used to define the boundaries by encoding the residue near the block-boundaries. This approach is slightly less efficient in coding but results in zero coding latency.
   (2) Boundary exclusion and interpolation: During encoding, overlapped data blocks with a small overlapped data region that contains all the concentrated residue energy are used, resulting in a small coding latency. During decoding, each reconstructed block excludes the boundary regions where residue energy concentrates, resulting in a minimized time-domain residue and block-discontinuity. Boundary interpolation is then used to further reduce the block-discontinuity.
5. Modeling the remaining residue energy as bands of stochastic noise, which provides the psychoacoustic masking for artifacts that may be introduced in the signal modeling, and approximates the original noise floor.

The characteristics and advantages of this procedural framework are the following:

1. It applies to any transform-based (actually, any reversible operation-based) coding of an arbitrary continuous signal (including but not limited to audio signals) employing quantization that approximates the original signal waveform.
2. Great flexibility, in that it allows for many different classes of solutions.
3. It allows for block-to-block adaptive change in transformation, resulting in potentially optimal signal modeling and transient fidelity.
4. It yields very low to zero coding latency since it does not rely on a long history buffer to maintain the block continuity.
5. It is simple and low in computational complexity.

Application of Framework for Reduction of Quantization-Induced Block-Discontinuity to Audio Compression. An ideal audio compression algorithm may include the following features:

1. Flexible and dynamic signal modeling for coding efficiency;
2. Continuity preservation without introducing long coding latency or compromising the transient fidelity;
3. Low computation complexity for real-time applications.

Traditional approaches to reducing quantization-induced block-discontinuities arising from lossy compression and decompression of continuous signals typically rely on a long history buffer (e.g., multiple frames) to maintain the boundary continuity at the expense of codec latency, transient fidelity, and coding efficiency. The transient response gets compromised due to the averaging or smearing effects of a long history buffer. The coding efficiency is also reduced because maintenance of continuity through a long history buffer precludes adaptive signal modeling, which is necessary when dealing with the dynamic nature of arbitrary audio signals. The framework of the present invention offers a solution for coding of continuous data, particularly audio data, without such compromises. As stated in the last subsection, this framework is very flexible in nature, which allows for many possible implementations of coding algorithms. Described below is a novel and practical general purpose, low-latency, and efficient audio coding algorithm.

Adaptive Cosine Packet Transform (ACPT). The (wavelet or cosine) packet transform (PT) is a well-studied subject in the wavelet research community as well as in the data compression community. A wavelet transform (WT) results in transform coefficients that represent a mixture of time and frequency domain characteristics. One characteristic of WTs is that it has mathematically compact support. In other words, the wavelet has basis functions that are non-vanishing only in a finite region, in contrast to sine waves that extend to infinity. The advantage of such compact support is that WTs can capture more efficiently the characteristics of a transient signal impulse than FFTs or DCTs can PTs have the further advantage that they adapt to the input signal time scale through best basis analysis (by minimizing certain parameters like entropy), yielding even more efficient representation of a transient signal event. Although one can certainly use WTs or PTs as the transform of choice in the present audio coding framework, it is the inventors intention to present ACPT as the preferred transform for an audio codec. One advantage of using a cosine packet transform (CPT) for audio coding is that it can efficiently capture transient signals, while also adapting to harmonic-like (sinusoidal-like) signals appropriately.

ACPTs are an extension to conventional CPTs that provide a number of advantages. In low bit-rate audio coding, coding efficiency is improved by using longer audio coding frames (blocks). When a highly transient signal is embedded in a longer coding frame. CPTs may not capture the fast time response. This is because, for example, in the best basis analysis algorithm that minimizes entropy, entropy may not be the most appropriate signature (nonlinear dependency on the signal normalization factor is one reason) for time scale adaptation under certain signal conditions. An ACPT provides an alternative by pre-splitting the longer coding frame into sub-frames through an adaptive switching mechanism, and the applying a CPT on the subsequent sub-frames. The "best basis" associated with ACPTs is called the extended best basis.

Signal and Residue Classifier (SRC). To achieve low bit-rate compression (e.g., at 1-bit per sample or lower), it is beneficial to separate the strong signal component coefficients in the set of transform coefficients from the noise and very weak signal component coefficients. For the purpose of this document, the term "residue" is used to describe both noise and weak signal components. A Signal and Residue Classifier (SRC) may be implemented in different ways. One approach is to identify all the discrete strong signal components from the residue, yielding a sparse vector signal coefficient frame vector, where subsequent adaptive sparse vector quantization (ASVQ) is used as the preferred quantization mechanism. A second approach is based on one simple observation of natural signals: the strong signal component coefficients tend to be clustered. Therefore, this second approach would separate the strong signal clusters from the contiguous residue coefficients. The subsequent quantization of the clustered signal vector can be regarded as a special type of ASVQ (global clustered sparse vector type). It has been shown that the second approach generally yields higher coding efficiency since signal components are clustered, and thus fewer bits are required to encode their locations.

ASVQ. As mentioned in the last section. ASVQ is the preferred quantization mechanism for the strong signal components. For a discussion of ASVQ, please refer to allowed U.S. patent application Ser. No. 08/958,567 by Shuwu Wu and John Mantegna, entitled "Audio Codec using Adaptive Sparse Vector Quantization with Subband Vector Classification", filed Oct. 28, 1997, which is assigned to the assignee of the present invention and hereby incorporated by reference.

In addition to ASVQ, the preferred embodiment employs a mechanism to provide bit-allocation that is appropriate for the block-discontinuity minimization. This simple yet effective bit-allocation also allows for short-term bit-rate prediction, which proves to be useful in the rate-control algorithm.

Stochastic Noise Model. While the strong signal components are coded more rigorously using ASVQ, the remaining residue is treated differently in the preferred embodiment. First, the extended best basis from applying an ACPT is used to divide the coding frame into residue sub-frames. Within each residue sub-frame, the residue is then modeled as bands of stochastic noise. Two approaches may be used:

1. One approach simply calculates the residue amplitude or energy in each frequency band. Then random DCT coefficients are generated in each band to match the original residue energy. The inverse DCT is performed on the combined DCT coefficients to yield a time-domain residue signal.
2. A second approach is rooted in time-domain filter bank approach. Again the residue energy is calculated and quantized. On reconstruction, a predetermined bank of filters is used to generate the residue signal for each frequency band. The input to these filters is white noise, and the output is gain-adjusted to match the original residue energy. This approach offers gain interpolation for each residue band between residue frames, yielding continuous residue energy.

Rate Control Algorithm. Another aspect of the invention is the application of rate control to the preferred codec. The rate control mechanism is employed in the encoder to better target the desired range of bit-rates. The rate control mechanism operates as a feedback loop to the SRC block and the ASVQ. The preferred rate control mechanism uses a linear model to predict the short-term bit-rate associated with the current coding frame. It also calculates the long-term bit-rate. Both the short- and long-term bit-rates are then used to select appropriate SRC and ASVQ control parameters. This rate control mechanism offers a number of benefits, including reduced complexity in computation complexity without applying quantization and in situ adaptation to transient signals.

Flexibility. As discussed above, the framework for minimization of quantization-induced block-discontinuity allows for dynamic and arbitrary reversible transform-based signal modeling. This provides flexibility for dynamic switching among different signal models and the potential to produce near-optimal coding. This advantageous feature is simply not available in the traditional MPEG I or MPEG II audio codecs or in the advanced audio codec (AAC). (For a detailed description of AAC, please see the References section below). This is important due to the dynamic and arbitrary nature of audio signals. The preferred audio codec of the invention is a general purpose audio codec that applies to, all music, sounds, and speech. Further, the codec's inherent low latency is particularly useful in the coding of short (on the order of one second) sound effects.

Scalability. The preferred audio coding algorithm of the invention is also very scalable in the sense that it can produce low bit-rate (about 1 bit/sample) full bandwidth audio compression at sampling rates ranging from 8 kHz to 44 kHz with only minor adjustments in coding parameters. This algorithm can also be extended to high quality audio and stereo compression.

Audio Encoding/Decoding. The preferred audio encoding and decoding embodiments of the invention form an audio coding and decoding system that achieves audio compression at variable low bit-rates in the neighborhood of 0.5 to 1.2 bits per sample. This audio compression system applies to both low bit-rate coding and high quality transparent coding and audio reproduction at a higher rate. The following sections separately describe preferred encoder and decoder embodiments.

Audio Encoding

FIG. 2 is a block diagram of a preferred general purpose audio encoding system in accordance with the invention. The preferred audio encoding system may be implemented in software or hardware, and comprises 8 major functional blocks, 100–114, which are described below.

Boundary Analysis 100. Excluding any signal pre-processing that converts input audio into the internal codec sampling frequency and pulse code modulation (PCM) representation, boundary analysis 100 constitutes the first functional block in the general purpose audio encoder. As discussed above, either of two approaches to reduction of quantization-induced block-discontinuities may be applied. The first approach (residue quantization) yields zero latency at a cost of requiring encoding of the residue waveform near the block boundaries ("near" typically being about 1/16 of the block size). The second approach (boundary exclusion and interpolation) introduces a very small latency, but has better coding efficiency because it avoids the need to encode the residue near the block boundaries, where most of the residue energy concentrates. Given the very small latency that this second approach introduces in the audio coding relative to a state-of-the-art MPEG AAC codec (where the latency is multiple frames vs. a fraction of a frame for the preferred codec of the invention), it is preferable to use the second approach for better coding efficiency, unless zero latency is absolutely required.

Although the two different approaches have an impact on the subsequent vector quantization block, the first approach can simply be viewed as a special case of the second approach as far as the boundary analysis function 100 and synthesis function 212 (see FIG. 3) are concerned. So a description of the second approach suffices to describe both approaches.

Figure 4:
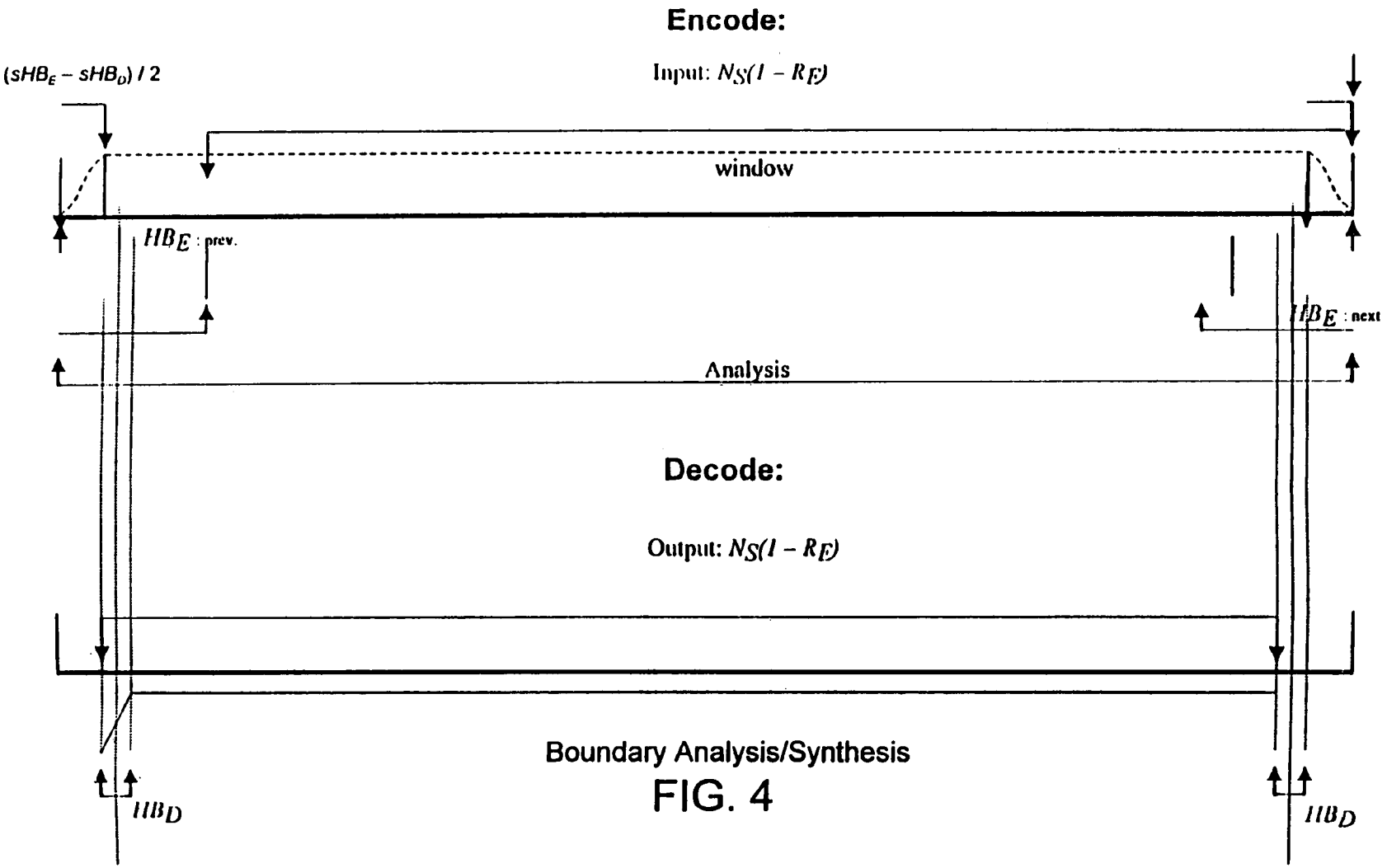
FIG. 4 illustrates the boundary analysis and synthesis aspects of the invention.

FIG. 4 illustrates the boundary analysis and synthesis aspects of the invention. The following technique is illustrated in the top (Encode) portion of FIG. 4. An audio coding (analysis or synthesis) frame consists of a sufficient (should be no less than 256, preferably 1024 or 2048) number of samples, Ns. In general, larger Ns values lead to higher coding efficiency, but at a risk of losing fast transient response fidelity. An analysis history buffer ($HB_E$) of size $sHB_E=R_E*Ns$ samples from the previous coding frame is kept in the encoder, where $R_E$ is a small fraction (typically set to 1/16 or 1/8 of the block size) to cover regions near the block boundaries that have high residue energy. During the encoding of the current frame $sInput=(1-R_E)*Ns$ samples are taken in and concatenated with the samples in $HB_E$ to form a complete analysis frame. In the decoder, a similar synthesis history buffer ($HB_D$) is also kept for boundary interpolation purposes, as described in a later section. The size of $HB_D$ is $sHB_D=R_D*sHB_E=R_D*R_E*Ns$ samples, where $R_D$ is a fraction, typically set to 1/4.

A window function is created during audio codec initialization to have the following properties: (1) at the center region of $Ns-sHB_E+sHB_D$ samples in size, the window function equals unity (i.e., the identity function); and (2) the remaining equally divided left and right edges typically equate to the left and right half of a bell-shape curve, respectively. A typical candidate bell-shape curve could be a Hamming or Kaiser-Bessel window function. This window function is then applied on the analysis frame samples. The analysis history buffer ($HB_E$) is then updated by the last $SHB_E$ samples from the current analysis frame. This completes the boundary analysis.

When the parameter $R_E$ is set to zero, this analysis reduces to the first approach mentioned above. Therefore, residue quantization can be viewed as a special case of boundary exclusion and interpolation.

Normalization 102. An optional normalization function 102 in the general purpose audio codec performs a normalization of the windowed output signal from the boundary analysis block. In the normalization function 102, the average time-domain signal amplitude over the entire coding frame (Ns samples) is calculated. Then a scalar quantization of the average amplitude is performed. The quantized value is used to normalize the input time-domain signal. The purpose of this normalization is to reduce the signal dynamic range, which will result in bit savings during the later quantization stage. This normalization is performed after boundary analysis and in the time-domain for the following reasons: (1) the boundary matching needs to be performed on the original signal in the time-domain where the signal is continuous; and (2) it is preferable for the scalar quantization table to be independent of the subsequent transform, and thus it must be performed before the transform. The scalar normalization factor is later encoded as part of the encoding of the audio signal.

Transform 104. The transform function 104 transforms each time-domain block to a transform domain block comprising a plurality of coefficients. In the preferred embodiment, the transform algorithm is an adaptive cosine packet transform (ACPT). ACPT is an extension or generalization of the conventional cosine packet transform (CPT). CPT consists of cosine packet analysis (forward transform) and synthesis (inverse transform). The following describes the steps of performing cosine packet analysis in the preferred embodiment. Note: Mathwork's Matlab notation is used in the pseudo-codes throughout this description, where: 1:m implies an array of numbers with starting value of 1, increment of 1, and ending value of m; and .*, ./, and .^2 indicate the point-wise multiply, divide and square operations, respectively.

CPT: Let N be the number of sample points in the cosine packet transform. D be the depth of the finest time splitting, and Nc be the number of samples at the finest time splitting (Nc=N/2^D, must be an integer). Perform the following:

1. Pre-calculate bell window function bp (interior to domain) and bm (exterior to domain):

```
m = Nc/2;
x = 0.5 * [1 + (0.5:m-0.5) / m];
if USE_TRIVIAL_BELL_WINDOW
  bp = sqrt(x);
elseif USE_SINE_BELL_WINDOW
  bp = sin(pi / 2 * x);
end
bm = sqrt(1 - bp.^2).
```

2. Calculate cosine packet transform table, pkt, for input N-point data x:

```
pkt = zeros(N,D+1);
for d = D:-1:0,
  nP = 2^d;
  Nj = N / nP;
  for b = 0:nP-1,
    ind = b*Nj + (1:Nj);
    ind1 = 1:m; ind2 = Nj+1 - ind1;
    if b == 0
      xc = x(ind);
      xl = zeros(Nj,1);
      xl(ind2) = xc(ind1) .* (1-bp) ./ bm;
    else
      xl = xc;
      xc = xr;
    end
    if b < nP-1,
      xr = x(Nj+ind);
    else
      xr = zeros(Nj, 1);
      xr(ind1) = -xc(ind2) .* (1-bp) ./ bm;
    end
    xlcr = xc;
    xlcr(ind1) = bp .* xlcr(ind1) + bm .* xl(ind2);
    xlcr(ind2) = bp .* xlcr(ind2) - bm .* xr(ind1);
    c = sqrt(2/Nj) * dct4(xlcr);
    pkt(ind, d+1) = c;
  end
end
```

The function dct4 is the type IV discrete cosine transform. When Nc is a power of 2, a fast dct4 transform can be used.

3. Build the statistics tree, stree, for the subsequent best basis analysis. The following pseudo-code demonstrates only the most common case where the basis selection is based on the entropy of the packet transform coefficients:

```
stree = zeros(2^(D+1)-1,1);
pktN_1 = norm(pkt(:,1));
if pktN_1 ~= 0,
  pktN_1 = 1 / pktN_1;
else
```

-continued

```
    pktN_1 = 1;
  end
  i = 0;
  for d = 0:D,
    nP = 2^d;
    Nj = N / nP;
    for b = 0:nP−1,
        i = i+1;
        ind = b * Nj + (1:Nj);
        p = (pkt(ind, d+1) * pktN_1) .^2;
        stree(i) = − sum(p .* log(p+eps));
     end;
  end;
```

4. Perform the best basis analysis to determine the best basis tree, btree:

```
btree =zeros(2^(D+1)−1, 1);
vtree = stree;
for d = D−1:−1:0,
  nP = 2^d;
  for b = 0:nP−1,
    i = nP +b;
    vparent = stree(i);
    vchild = vtree(2*i) + vtree(2*i+1);
    if vparent <= vchild,
      btree(i) = 0;          (terminating node)
      vtree(i) = vparent;
    else
      btree(i) = 1;          (non-terminating node)
      vtree(i) = vchild;
    end
  end
end
entropy = vtree(1).    (total entropy for cosine packet transform
coefficients)
```

5. Determine (optimal) CPT coefficients, opkt, from packet transform table and the best basis tree:

```
  opkt = zeros(N, 1);
  stack = zeros(2^(D+1), 2);
  k = 1;
  while (k > 0),
    d = stack(k, 1);
    b = stack(k, 2);
    k = k−1;
    nP = 2^d;
    i = nP + b;
    if btree(i) == 0,
      Nj = N / nP;
      ind = b * Nj + (1:Nj);
      opkt(ind) = pkt(ind, d+1);
    else
      k = k+1; stack(k, :) = [d+1 2*b];
      k = k+1; stack(k, :) = [d+1 2*b+1];
    end
  end
```

For a detailed description of wavelet transforms, packet transforms, and cosine packet transforms, see the References section below.

As mentioned above, the best basis selection algorithms offered by the conventional cosine packet transform sometimes fail to recognize the very fast (relatively speaking) time response inside a transform frame. We determined that it is necessary to generalize the cosine packet transform to what we call the "adaptive cosine packet transform", ACPT. The basic idea behind ACPT is to employ an independent adaptive switching mechanism, on a frame by frame basis, to determine whether a pre-splitting of the CPT frame at a time splitting level of D1 is required, where 0<=D1<=D. If the pre-splitting is not required, ACPT is almost reduced to CPT with the exception that the maximum depth of time splitting is D2 for ACPTs' best basis analysis, where D1<=D2<=D.

The purpose of introducing D2 is to provide a means to stop the basis splitting at a point (D2) which could be smaller than the maximum allowed value D, thus de-coupling the link between the size of the edge correction region of ACPT and the finest splitting of best basis. If pre-splitting is required, then the best basis analysis is carried out for each of the pre-split sub-frames, yielding an extended best basis tree (a 2-D array, instead of the conventional 1-D array). Since the only difference between ACPT and CPT is to allow for more flexible best basis selection, which we have found to be very helpful in the context of low bit-rate audio coding, ACPT is a reversible transform like CPT.

ACPT: The preferred ACPT algorithm follows:

1. Pre-calculate the bell window functions, bp and bm, as in Step 1 of the CPT algorithm above.
2. Calculate the cosine packet transform table just for the time splitting level of D1, pkt(:,D1+1), as in CPT Step 2, but only for d=D1 (instead of d=D:−1:0).
3. Perform an adaptive switching algorithm to determine whether a pre-split at level D1 is needed for the current ACPT frame. Many algorithms are available for such adaptive switching. One can use a time-domain based algorithm, where the adaptive switching can be carried out before Step 2. Another class of approaches would be to use the packet transform table coefficients at level D1. One candidate in this class of approaches is to calculate the entropy of the transform coefficients for each of the pre-split sub-frames individually. Then, an entropy-based switching criterion can be used. Other candidates include computing some transient signature parameters from the available transform coefficients from Step 2, and then employing some appropriate criteria. The following describes only a preferred implementation:

```
nP1 = 2^D1;
Nj = N / nP1;
entropy = zeros(1, nP1);
amplitude = zeros(1, nP1);
index = zeros(1, nP1);
for i = 0:nP1−1,
  ind = i*Nj + (1:Nj);
  ci = pkt(ind, D1+1);
  norm_1 = norm(ci);
```

-continued

```
  amplitude(i) = norm_1;
  if norm_1 ~= 0,
    norm_1 = 1 / norm_1;
  else
    norm_1 = 1
  end
  p = (norm_1*x) .^2;
  entropy(i+1) = - sum(p .* log(p+eps));
  ind2 = quickSort(abs(ci)); (quick sort index by abs(ci) in ascending order)
  ind2 = ind2(N+1 - (1:Nt));        (keep Nt indices associated with Nt largest abs(ci))
  index(i) = std(ind2); (standard deviation of ind2, spectrum spread)
end
if mean(amplitude) > 0.0,
  amplitude = amplitude / mean(amplitude);
end
mEntropy = mean(entropy);
mIndex = mean(index);
if max(amp) - min(amp) > thr1 | mIndex < thr2 * mEntropy,
  PRE-SPLIT_REQUIRED
else
  PRE-SPLIT_NOT_REQUIRED
end;
```

where: Nt is a threshold number which is typically set to a fraction of Nj (e.g., Nj/8). The thr1 and thr2 are two empirically determined threshold values. The first criterion detects the transient signal amplitude variation, the second detects the transform coefficients (similar to the DCT coefficients within each sub-frame) or spectrum spread per unit of entropy value.

4. Calculate pkt at the required levels depending on pre-split decision:

```
if PRE-SPLIT_REQUIRED
    CALCULATE pkt for levels = [D1+1:D2];
else
    if D1 < D0,
      CALCULATE pkt for levels = [0:D1-1 D1+1:D0];
    elseif D1 == D0,
      CALCULATE pkt for levels = [0:D0-1];
    else
      CALCULATE pkt for levels = [0:D0];
    end
end;
```

where D0 and D2 are the maximum depths for time-splitting PRE-SPLIT_REQUIRED and PRE-SPLIT_NOT_REQUIRED, respectively.

5. Build statistics tree, stree, as in CPT Step 3, for only the required levels.
6. Split the statistics tree, stree, into the extended statistics tree, strees, which is generally a 2-D array. Each 1-D sub-array is the statistics tree for one sub-frame. For the PRE-SPLIT_REQUIRED case, there are 2^D1 such sub-arrays. For the PRE-SPLIT_NOT_REQUIRED case, there is no splitting (or just one sub-frame), so there is only one sub-array, i.e., strees becomes a 1-D array. The details are as follows:

```
if PRE-SPLIT_NOT_REQUIRED,
  strees = stree;
else
  nP1 = 2^D1;
  strees = zeros(2^(D2-D1+1)-1. nP1);
  index = nP1;
```

-continued

```
  d2 = D2-D1;
  for d = 0:d2,
    for i = 1:nP1,
      for j = 2^d-1 + (1:2^d),
        strees(j, i) = stree(index);
        index = index+1;
      end
    end
  end
end
```

7. Perform best basis analysis to determine the extended best basis tree, btrees, for each of the sub-frames the same way as in CPT Step 4.
8. Determine the optimal transform coefficients, opkt, from the extended best basis tree. This involves determining opkt for each of the sub-frames. The algorithm for each sub-frame is the same as in CPT Step 5.

Because ACPT computes the transform table coefficients only at the required time-splitting levels. ACPT is generally less computationally complex than CPT.

The extended best basis tree (2-D array) can be considered an array of individual best basis trees (1-D) for each sub-frame. A lossless (optimal) variable length technique for coding a best basis tree is preferred:

```
d = maximum depth of time-splitting for the best basis tree in question
code = zeros(1,2^d-1);
code(1) = btree(1); index = 1;
for i = 0:d-2,
  nP = 2^i;
  for b = 0:nP-1,
    if btree(nP+b) == 1,
      code(index + (1:2)) = btree(2*(nP+b) + (0:1)); index = index + 2;
    end
  end
end
code = code(1:i);    (quantized bit-stream, i bits used)
```

Signal and Residue Classifier 106. The signal and residue classifier (SRC) function 106 partitions the coefficients of each time-domain block into signal coefficients and residue coefficients. More particularly, the SRC function 106 separates strong input signal components (called signal) from noise and weak signal components (collectively called residue). As discussed above, there are two preferred approaches for SRC. In both cases. ASVQ is an appropriate technique for subsequent quantization of the signal. The following describes the second approach that identifies signal and residue in clusters:

1. Sort index in ascending order of the absolute value of the ACPT coefficients, opkt:

```
ax=abs(opkt);

order=quickSort(ax);
```

2. Calculate global noise floor. gnf:

```
gnf=ax(N−Nt);
```

where Nt is a threshold number which is typically set to a fraction of N.

3. Determine signal clusters by calculating zone indices, zone, in the first pass:

```
zone = zeros(2, N/2);          (assuming no more than N/2 signal clusters)
zc = 0;
i = 1;
inS = 0;
sc = 0;
while i <= N,
  if ~inS & ax(i) <= gnf,
  elseif ~inS & ax(i) > gnf,
    zc = zc+1;
    inS = 1;
    sc = 0;
    zone(1, zc) = i;          (start index of a signal cluster)
  elseif inS & ax(i) <= gnf,
    if sc >= nt,          (nt is a threshold number, typically set to 5)
      zone(2, zc) = i;
      inS = 0;
      sc = 0;
    else
      sc = sc + 1;
    end;
  elseif inS & ax(i) > gnf
    sc = 0;
  end
  i = i + 1;
  end;
if zc > 0 & zone(2,zc) == 0,
  zone(2, zc) = N;
end;
zone = zone(:, 1:zc);
for i = 1:zc,
  indH = zone(2, i);
  while zc(indH) <= gnf,
    indH = indH − 1;
  end;
  zone(2, i) = indH;
end;
```

4. Determine the signal clusters in the second pass by using a local noise floor lnf; sRR is the size of the neighboring residue region for local noise floor estimation purposes, typically set to a small fraction of N (e.g., N/32):

```
zone0 = zone(2, :);
for i = 1:zc,
    indL = max(1, zone(1,i)−sRR); indH = min(N, zone(2,i)−sRR);
    index = indL:indH;
    index = indL−1 + find(ax(index) <= gnf);
    if length(index) == 0,
        Inf = gnf;
    else
        Inf = ratio * mean(ax(index));(ratio is threshold number,
        typically set to 4.0)
```

-continued

```
    end;
    if Inf < gnf,
        indL = zone(1, i); indH = zone(2, i);
        if i = 1,
            indl = 1;
        else
            indl = zone0(i−1);
        end
        if i == zc,
            indh = N;
        else
            indh = zone0(i+1);
        end
        while indL > indl & ax(indL) > Inf,
            indL = indL − 1;
        end;
        while indH < indh & ax(indH) > Inf,
            indH = indH + 1;
        end;
        zone(1, i) = indL; zone(2, i) = indH;
    elseif Inf > gnf,
        indL = zone(1, i); indH = zone(2, i);
        while indL <= indH & ax(indL) <= Inf,
            indL = indL + 1;
        end;
        if indL > indH,
            zone(1, i) = 0; zone(2, i) = 0;
        else
            while indH >= indL & ax(indH) <= Inf,
                indH = indH − 1;
            end
            if indH < indL,
                zone(1, i) = 0; zone(2, i) = 0;
            else
                zone(1, i) = indL; zone(2, i) = indH;
            end
        end
    end
end
```

5. Remove the weak signal components:

```
for i = 1:zc,
    indL = zone(1, i);
    if indL > 0,
        indH = zone(2, i); index = indL:indH;
        if max(ax(index)) > Athr,      (Athr typically set to 2)
            while ax(indL) < Xthr,  (Xthr typically set to 0.2)
                indL = indL+1;
            end
            while ax(indH) < Xthr,
                indH = indH+1;
            end
            zone(1, i) = indL; zone(2, i) = indH;
        end
    end
end
```

6. Remove the residue components:

```
index=find(zone(1,:))>0);

zone=zone(:, index);

zc=size(zone, 2);
```

7. Merge signal clusters that are close neighbors:

```
for i = 2:zc,
    indL = zone(1, i);
    if indL > 0 & indL − zone(2, ii−1) < minZS,
        zone(1, i) = zone(1, i−1);
        zone(1, i−1) = 0; zone(2, i−1) = 0;
    end
end
```

where minZS is the minimum zone size, which is empirically determined to minimize the required quantization bits for coding the signal zone indices and signal vectors.

8. Remove the residue components again, as in Step 6.

Quantization 108. After the SRC 106 separates ACPT coefficients into signal and residue components, the signal components are processed by a quantization function 108. The preferred quantization for signal components is adaptive sparse vector quantization (ASVQ).

If one considers the signal clusters vector as the original ACPT coefficients with the residue components set to zero, then a sparse vector results. As discussed in allowed U.S. patent application Ser. No. 08/958,567 by Shuwu Wu and John Mantegna, entitled "Audio Codec using Adaptive Sparse Vector Quantization with Subband Vector Classification", filed Oct. 28, 1997, ASVQ is the preferred quantization scheme for such sparse vectors. In the case where the signal components are in clusters, type IV quantization in ASVQ applies. An improvement to ASVQ type IV quantization can be accomplished in cases where all signal components are contained in a number of contiguous clusters. In such cases, it is sufficient to only encode all the start and end indices for each of the clusters when encoding the element location index (ELI). Therefore, for the purpose of ELI quantization, instead of encoding the original sparse vector, a modified sparse vector (a super-sparse vector) with only non-zero elements at the start and end points of each signal cluster is encoded. This results in very significant bit savings. That is one of the main reasons it is advantageous to consider signal clusters instead of discrete components. For a detailed description of Type IV quantization and quantization of the ELI, please refer to the patent application referenced above. Of course, one can certainly use other lossless techniques, such as run length coding with Huffman codes, to encode the ELI.

ASVQ supports variable bit allocation, which allows various types of vectors to be coded differently in a manner that reduces psychoacoustic artifacts. In the preferred audio codec, a simple bit allocation scheme is implemented to rigorously quantize the strongest signal components. Such a fine quantization is required in the preferred framework due to the block-discontinuity minimization mechanism. In addition, the variable bit allocation enables different quality settings for the codec.

Stochastic Noise Analysis 110. After the SRC 106 separates ACPT coefficients into signal and residue components, the residue components, which are weak and psychoacoustically less important, are modeled as stochastic noise in order to achieve low bit-rate coding. The motivation behind such a model is that, for residue components, it is more important to reconstruct their energy levels correctly than to re-create their phase information. The stochastic noise model of the preferred embodiment follows:

1. Construct a residue vector by taking the ACPT coefficient vector and setting all signal components to zero.
2. Perform adaptive cosine packet synthesis (see above) on the residue vector to synthesize a time-domain residue signal.
3. Use the extended best basis tree, btrees, to split the residue frame into several residue sub-frames of variable sizes. The preferred algorithm is as follows:

join btrees to form a combined best basis tree, btree, as described in Section 5.12. Step 2

```
index = zeros(1, 2^D);
stack = zeros(2^D+1, 2);
k = 1;
nSF = 0;      (number of residue sub-frames)
while k > 0,
    d = stack(k, 1); b = stack(k, 2);
    k = k - 1;
    nP = 2^d; Nj = N / nP;
    i = nP + b;
    if btree(i) == 0,
        nSF = nSF + 1; index(nSF) = b * Nj;
    else
        k = k+1; stack(k, :) = [d+1 2*b];
        k = k+1; stack(k, :) = [d+1 2*b+1];
    end
end;
index = index(1:nSF);
sort index in ascending order
sSF = zeros(1, nSF);      (sizes of residue sub-frames)
sSF(1:nSF-1) = diff(index);
sSF(nSF) = N - index(nSF);
```

4. Optionally, one may want to limit the maximum or minimum sizes of residue sub-frames by further sub-splitting or merging neighboring sub-frames for practical bit-allocation control.
5. Optionally, for each residue sub-frame, a DCT or FFT is performed and the subsequent spectral coefficients are grouped into a number of subbands. The sizes and number of subbands can be variable and dynamically determined. A mean energy level then would be calculated for each spectral subband. The subband energy vector then could be encoded in either the linear or logarithmic domain by an appropriate vector quantization technique.

Rate Control 112. Because the preferred audio codec is a general purpose algorithm that is designed to deal with arbitrary types of signals, it takes advantage of spectral or temporal properties of an audio signal to reduce the bit-rate. This approach may lead to rates that are outside of the targeted rate ranges (sometime rates are too low and sometimes rates are higher than the desired, depending on the audio content). Accordingly, a rate control function 112 is optionally applied to bring better uniformity to the resulting bit-rates.

The preferred rate control mechanism operates as a feedback loop to the SRC 106 or quantization 108 functions. In particular, the preferred algorithm dynamically modifies the SRC or ASVQ quantization parameters to better maintain a desired bit rate. The dynamic parameter modifications are driven by the desired short-term and long-term bit rates. The short-term bit rate can be defined as the "instantaneous" bit-rate associated with the current coding frame. The long-term bit-rate is defined as the average bit-rate over a large number or all of the previously coded frames. The preferred algorithm attempts to target a desired short-term bit rate associated with the signal coefficients through an iterative process. This desired bit rate is determined from the short-term bit rate for the current frame and the short-term bit rate not associated with the signal coefficients of the previous frame. The expected short-term bit rate associated with the signal can be predicted based on a linear model:

$$\text{Predicted}=A(q(n))*S(c(m))+B(q(n)). \quad (1)$$

Here, A and B are functions of quantization related parameters, collectively represented as q. The variable q can take on values from a limited set of choices, represented by the variable n. An increase (decrease) in n leads to better (worse) quantization for the signal coefficients. Here, S represents the percentage of the frame that is classified as signal, and it is a function of the characteristics of the current frame. S can take on values from a limited set of choices, represented by the variable m. An increase (decrease) in m leads to a larger (smaller) portion of the frame being classified as signal.

Thus, the rate control mechanism targets the desired long-term bit rate by predicting the short-term bit rate and using this prediction to guide the selection of classification and quantization related parameters associated with the preferred audio codec. The use of this model to predict the short-term bit rate associated with the current frame offers the following benefits:

1. Because the rate control is guided by characteristics of the current frame, the rate control mechanism can react in situ to transient signals.
2. Because the short-term bit rate is predicted without performing quantization, reduced computational complexity results.

4. (HIGH, HIGH): The long-term bit rate is high and the short-term bit rate is high.

The preferred implementation of the rate control mechanism is outlined in the three-step procedure below. The four conditions differ in Step 3 only. The implementation of Step 3 for cases 1 (LOW, LOW) and 4 (HIGH, HIGH) are given below. Case 2 (LOW, HIGH) and Case 4 (HIGH, HIGH) are identical, with the exception that they have different values for the upper limit of the target short-term bit rate for the signal coefficients. Case 3 (HIGH, LOW) and Case 1 (HIGH, HIGH) are identical, with the exception that they have different values for the lower limit of the target short-term bit rate for the signal coefficients. Accordingly, given n and m used for the previous frame:

1. Calculate S(c(m)), the percentage of the frame classified as signal, based on the characteristics of the frame.
2. Predict the required bits to quantize the signal in the current frame based on the linear model given in equation (1) above, using S(c(m)) calculated in (1), A(n), and B(n).
3. Conditional processing step:

```
if the (LOW, LOW) case applies:
    do {
        if m < MAX_M
            m++;
        else
            end loop after this iteration
        end
        Repeat Steps 1 and 2 with the new parameter m (and therefore S(c(m)).
        if predicted short term bit rate for signal < lower limit of target short term bit
        rate for signal and n < MAX_N
            n++;
            if further from target than before
                n--; (use results with previous n)
                end loop after this iteration
            end
        end
} while (not end loop and (predicted short term bit rate for signal < lower limit of
target short term bit rate for signal) and (m < MAX_M or n < MAX_n))
end
if the (HIGH, HIGH) case applies:
    do {
        if m < MIN_M
            m--;
        else
            end loop after this iteration
        end
            Repeat Steps 1 and 2 with the new parameter m (and therefore S(c(m)).
            if predicted short term bit rate for signal > upper limit of target short term bit
            rate for signal and n > MIN_N
                n--;
                if further from target than before
                    n++; (use results with previous n)
                end loop after this iteration
            end
        end
    } while (not end loop and (predicted short term bit rate for signal > upper limit of
    target short term bit rate for signal) and (m > MIN_M or n > MIN_n))
end
```

The preferred implementation uses both the long-term bit rate and the short-term bit rate to guide the encoder to better target a desired bit rate. The algorithm is activated under four conditions:

1. (LOW, LOW): The long-term bit rate is low and the short-term bit rate is low.
2. (LOW, HIGH): The long-term bit rate is low and the short-term bit rate is high.
3. (HIGH, LOW): The long-term bit rate is high and the short-term bit rate is low.

In this implementation, additional information about which set of quantization parameters is chosen may be encoded.

Bit-Stream Formatting 124. The indices output by the quantization function 108 and the Stochastic Noise Analysis function 110 are formatted into a suitable bit-stream form by the bit-stream formatting function 114. The output information may also include zone indices to indicate the location of the quantization and stochastic noise analysis indices, rate control information, best basis tree information, and any normalization factors.

In the preferred embodiment, the format is the "ART" multimedia format used by America Online and further described in U.S. patent application Ser. No. 08/866,857, filed May 30, 1997, entitled "Encapsulated Document and Format System", assigned to the assignee of the present invention and hereby incorporated by reference. However, other formats may be used, in known fashion. Formatting may include such information as identification fields, field definitions, error detection and correction data, version information, etc.

The formatted bit-stream represents a compressed audio file that may then be transmitted over a channel, such as the Internet, or stored on a medium, such as a magnetic or optical data storage disk.

Audio Decoding

FIG. 3 is a block diagram of a preferred general purpose audio decoding system in accordance with the invention. The preferred audio decoding system may be implemented in software or hardware, and comprises 7 major functional blocks, 200–212, which are described below.

Bit-stream Decoding 200. An incoming bit-stream previously generated by an audio encoder in accordance with the invention is coupled to a bit-stream decoding function 200. The decoding function 200 simply disassembles the received binary data into the original audio data, separating out the quantization indices and Stochastic Noise Analysis indices into corresponding signal and noise energy values, in known fashion.

Stochastic Noise Synthesis 202. The Stochastic Noise Analysis indices are applied to a Stochastic Noise Synthesis function 202. As discussed above, there are two preferred implementations of the stochastic noise synthesis. Given coded spectral energy for each frequency band, one can synthesize the stochastic noise in either the spectral domain or the time-domain for each of the residue sub-frames.

The spectral domain approaches generate pseudo-random numbers, which are scaled by the residue energy level in each frequency band. These scaled random numbers for each band are used as the synthesized DCT or FFT coefficients. Then, the synthesized coefficients are inversely transformed to form a time-domain spectrally colored noise signal. This technique is lower in computational complexity than its time-domain counterpart, and is useful when the residue sub-frame sizes are small.

The time-domain technique involves a filter bank based noise synthesizer. A bank of band-limited filters, one for each frequency band, is pre-computed. The time-domain noise signal is synthesized one frequency band at a time. The following describes the details of synthesizing the time-domain noise signal for one frequency band:

1. A random number generator is used to generate white noise.
2. The white noise signal is fed through the band-limited filter to produce the desired spectrally colored stochastic noise for the given frequency band.
3. For each frequency band, the noise gain curve for the entire coding frame is determined by interpolating the encoded residue energy levels among residue sub-frames and between audio coding frames. Because of the interpolation, such a noise gain curve is continuous. This continuity is an additional advantage of the time-domain-based technique.
4. Finally, the gain curve is applied to the spectrally colored noise signal.

Steps 1 and 2 can be pre-computed, thereby eliminating the need for implementing these steps during the decoding process. Computational complexity can therefore be reduced.

Inverse Quantization 204. The quantization indices are applied to an inverse quantization function 204 to generate signal coefficients. As in the case of quantization of the extended best basis tree, the de-quantization process is carried out for each of the best basis trees for each sub-frame. The preferred algorithm for de-quantization of a best basis tree follows:

```
d = maximum depth of time-splitting for the best basis tree in question
maxWidth = 2^D−1;
read maxWidth bits from bit-stream to code(1:maxWidth);
(code = quantized bit-stream)
btree = zeros(2^(D+1)−1, 1);
btree(1) = code(1); index = 1;
for i = 0:d−2,
    nP = 2^i;
    for b = 0:nP−1,
        if btree(nP+b) == 1,
            btree(2*(nP+b) + (0:1)) = code(index+(1:2));
            index = index + 2;
        end
    end
end
code = code(1:i);          (actual bit used is i)
rewind bit pointer for the bit-stream by (maxWidth − i) bits.
```

The preferred de-quantization algorithm for the signal components is a straightforward application of ASVQ type IV de-quantization described in allowed U.S. patent application Ser. No. 08/958,567 referenced above.

Inverse Transform 206. The signal coefficients are applied to an inverse transform function 206 to generate a time-domain reconstructed signal waveform. In this example, the adaptive cosine synthesis is similar to its counterpart in CPT with one additional step that converts the extended best basis tree (2-D array in general) into the combined best basis tree (1-D array). Then the cosine packet synthesis is carried out for the inverse transform. Details follow:

1. Pre-calculate the bell window functions, bp and bm, as in CPT Step 1.
2. Join the extended best basis tree, btrees, into a combined best basis tree, btree, a reverse of the split operation carried out in ACPT Step 6:

```
if PRE-SPLIT_NOT_REQUIRED,
    btree = btrees;
else
    nP1 = 2^D1;
    btree = zeros(2^D+1)−1. 1);
    btree(1:nP1−1) = ones(nP1−1,1);
    index = nP1;
    d2 = D2−D1;
    for i = 0:d2−1,
        for j = 1:nP1,
            for k = 2^i−1 + (1:2^i),
                btree(index) = btrees(k, j);
                index = index+1;
            end
        end
    end
end
```

3. Perform cosine packet synthesis to recover the time-domain signal, y, from the optimal cosine packet coefficients, opkt:

```
m = N / 2^(D+1);
y = zeros(N, 1);
stack = zeros(2^D+1, 2);
k = 1;
while k > 0,
    d = stack(k, 1);
    b = stack(k, 2);
    k = k - 1;
    nP = 2^d;
    Nj = N / nP;
    i = nP + b;
    if btree(i) == 0,
        ind = b * Nj + (1:Nj);
        xlcr = sqrt(2/Nj) * dct4(opkt(ind));
        xc = xlcr;
        xl = zeros(Nj, 1);
        xr = zeros(Nj, 1);
        ind1 = 1:m;
        ind2 = Nj+1 - ind1;
        xc(ind1) = bp .* xlcr(ind1);
        xc(ind2) = bp .* xlcr(ind2);
        xl(ind2) = bm .* xlcr(ind1);
        xr(ind1) = -bm .* xlcr(ind2);
        y(ind) = y(ind) + xc;
        if b == 0,
            y(ind1) = y(ind1) + xc(ind1) .* (1-bp) ./ bp;
        else
            y(ind-Nj) = y(ind-Nj) + xl;
        end
        if b < nP-1,
            y(ind+Nj) = y(ind+Nj) + xr;
        else
            y(ind2+N-Nj) = y(ind2+N-Nj) + xc(ind2) .* (1-bp) ./ bp;
        end;
    else
        k = k+1; stack(k, :) = [d+1 2*b];
        k = k+1; stack(k, :) = [d+1 2*b+1];
    end;
end
```

Renormalization 208. The time-domain reconstructed signal and synthesized stochastic noise signal, from the inverse adaptive cosine packet synthesis function 206 and the stochastic noise synthesis function 202, respectively, are combined to form the complete reconstructed signal. The reconstructed signal is then optionally multiplied by the encoded scalar normalization factor in a renormalization function 208.

Boundary Synthesis 210. In the decoder, the boundary synthesis function 210 constitutes the last functional block before any time-domain post-processing (including but not limited to soft clipping, scaling, and re-sampling). Boundary synthesis is illustrated in the bottom (Decode) portion of FIG. 4. In the boundary synthesis component 210, a synthesis history buffer ($HB_D$) is maintained for the purpose of boundary interpolation. The size of this history ($sHB_D$) is a fraction of the size of the analysis history buffer ($sHB_E$), namely.

$sHB_D=R_D*sHB_E=R_D*R_E*Ns$, where Ns is the number of samples in a coding frame.

Consider one coding frame of Ns samples. Label them S[i], where i=0, 1, 2, . . . Ns. The synthesis history buffer keeps the $sHB_D$ samples from the last coding frame, starting at sample number Ns−sHBE/2−sHBD/2. The system takes $Ns-sHB_E$ samples from the synthesized time-domain signal (from the renormalization block), starting at sample number $sHB_E/2-sHB_D/2$.

These $Ns-sHB_E$ samples are called the pre-interpolation output data. The first $sHB_D$ samples of the pre-interpolation output data overlap with the samples kept in the synthesis history buffer in time. Therefore, a simple interpolation (e.g., linear interpolation) is used to reduce the boundary discontinuity. After the first $sHB_D$ samples are interpolated, the $Ns-sHB_E$ output data is then sent to the next functional block (in this embodiment, soft clipping 212). The synthesis history buffer is subsequently updated by the $sHB_D$ samples from the current synthesis frame, starting at sample number $Ns-sHB_E/2-sHB_D/2$.

The resulting codec latency is simply given by the following formula, $$\text{latency}=(sHB_E+sHB_D)/2=R_E*(1+R_D)*Ns/2 \text{ (samples).}$$

which is a small fraction of the audio coding frame. Since the latency is given in samples, higher intrinsic audio sampling rate generally implies lower codec latency.

Soft Clipping 212. In the preferred embodiment, the output of the boundary synthesis component 210 is applied to a soft clipping component 212. Signal saturation in low bit-rate audio compression due to lossy algorithms is a significant source of audible distortion if a simple and naive "hard clipping" mechanism is used to remove them. Soft clipping reduces spectral distortion when compared to the conventional "hard clipping" technique. The preferred soft clipping algorithm is described in allowed U.S. patent application Ser. No. 08/958,567 referenced above.

Computer Implementation

The invention may be implemented in hardware or software, or a combination of both (e.g., programmable logic arrays). Unless otherwise specified, the algorithms included as part of the invention are not inherently related to any particular computer or other apparatus. In particular, various general purpose machines may be used with programs written in accordance with the teachings herein, or it may be more convenient to construct more specialized apparatus to perform the required method steps. However, preferably, the invention is implemented in one or more computer programs executing on programmable systems each comprising at least one processor, at least one data storage system (including volatile and non-volatile memory and/or storage elements), at least one input device, and at least one output device. The program code is executed on the processors to perform the functions described herein.

Each such program may be implemented in any desired computer language (including but not limited to machine, assembly, and high level logical, procedural, or object oriented programming languages) to communicate with a computer system. In any case, the language may be a compiled or interpreted language.

Each such computer program is preferably stored on a storage media or device (e.g., ROM, CD-ROM, or magnetic or optical media) readable by a general or special purpose programmable computer, for configuring and operating the computer when the storage media or device is read by the computer to perform the procedures described herein. The inventive system may also be considered to be implemented as a computer-readable storage medium, configured with a computer program, where the storage medium so configured causes a computer to operate in a specific and predefined manner to perform the functions described herein.

References

M. Bosi, et al., "ISO/IEC MPEG-2 advanced audio coding", Journal of the Audio Engineering Society, vol. 45, no. 10, pp. 789–812, October 1997.

S. Mallat, "A theory for multiresolution signal decomposition: The wavelet representation", IEEE Trans. Patt. Anal. Mach. Intell., vol. 11. pp. 674–693, July 1989.

R. R. Coifman and M. V. Wickerhauser, "Entropy-based algorithms for best basis selection", IEEE Trans. Inform. Theory, Special Issue on Wavelet Transforms and Multires. Signal Anal., vol. 38. pp. 713–718, March 1992.

M. V. Wickerhauser. "Acoustic signal compression with wavelet packets", in Wavelets: A Tutorial in Theory and Applications, C. K. Chui, Ed. New York: Academic, 1992. pp. 679–700.

C. Herley, J. Kovacevic. K. Ramchandran, and M. Vetterli. "Tilings of the Time-Frequency Plane: Construction of Arbitrary Orthogonal Bases and Fast Tiling Algorithms", IEEE Trans, on Signal Processing, vol. 41, No. 12, pp. 3341–3359. December 1993.

A number of embodiments of the present invention have been described. Nevertheless, it will be understood that various modifications may be made without departing from the spirit and scope of the invention. For example, some of the steps of various of the algorithms may be order independent, and thus may be executed in an order other than as described above. As another example, although the preferred embodiments use vector quantization, scalar quantization may be used if desired in appropriate circumstances. Accordingly, other embodiments are within the scope of the following claims.

What is claimed is:

1. A method for performing an adaptive cosine packet transform, including:

receiving audio data calculating bell window functions;

applying the bell window functions to the audio data to create at least one time splitting level;

calculating a cosine packet transform table for at least one time splitting level;

determining whether a pre-split at the time splitting level is needed for a current frame;

recalculating the cosine packet transform table at selected levels depending on the pre-split determination;

building a statistics tree for only the selected levels;

generating an extended statistics tree from the statistics tree;

performing a best basis analysis to determine an extended best basis tree from the extended statistics tree; and determining optimal transform coefficients from the extended best basis tree.

2. The method claim 1 further including:

determining how to perform the pre-split for the current cosine packet transform frame to form the pre-split subframes; and performing the pre-split for the current cosine packet transform frame to form the pre-split subframes.

3. A method for performing an adaptive cosine packet transform, including: receiving audio data determining whether a pre-split is needed for a current cosine packet transform frame based on the audio data to form pre-split subframes;

applying a cosine packet transform to the pre-split subframes based on the determination;

performing a best basis analysis; and determining optimal transform coefficients.

4. The method claim 3 further including:

determining how to perform the pre-split for the current cosine packet transform frame to form the pre-split subframes; and performing the pre-split for the current cosine packet transform frame to form the pre-split subframes.

5. The method of claim 3 further including:

calculating bell window functions; and calculating a cosine packet transform table only for a time splitting level utilizing the bell window functions.

6. The method of claim 3 wherein performing the best basis analysis includes:

building a statistics tree for the pre-split subframes;

generating an extended statistics tree from the statistics tree; and performing the best basis analysis to determine an extended best basis tree from the extended statistics tree.

7. The method of claim 6 wherein determining the optimal transform coefficients includes determining the optimal transform coefficients from the extended best basis tree.

8. A computer program, residing on a computer-readable medium, for performing an adaptive cosine packet transform, the computer program comprising instructions for causing a computer to:

receive audio data;

calculate bell window functions;

apply the bell window functions to the audio data to create at least one time splitting level;

calculate a cosine packet transform table for at least one time splitting level;

determine whether a pre-split at the time splitting level is needed for a current frame;

recalculate the cosine packet transform table at selected levels depending on the pre-split determination;

build a statistics tree for only the selected levels;

generate an extended statistics tree from the statistics tree;

perform a best basis analysis to determine an extended best basis tree from the extended statistics tree; and determine optimal transform coefficients from the extended best basis tree.

9. The computer program of claim 8 further including instructions for causing the computer to:

determine how to perform the pre-split for the current cosine packet transform frame to form the pre-split subframes; and perform the pre-split for the current cosine packet transform frame to form the pre-split subframes.

10. A computer program, residing on a computer-readable medium, for performing an adaptive cosine packet transform, the computer program comprising instructions for causing a computer to: receive audio data determine whether a pre-split is needed for a current cosine packet transform frame based on the audio data to form pre-split subframes;

apply a cosine packet transform to the pre-split subframes based on the determination;

perform a best basis analysis; and determine optimal transform coefficients.

11. The computer program of claim 10 further including instructions for causing the computer to:

determine how to perform the pre-split for the current cosine packet transform frame to form the pre-split subframes; and perform the pre-split for the current cosine packet transform frame to form the pre-split subframes.

12. The computer program of claim 10 further including instructions for causing the computer to:

calculate bell window functions; and calculate a cosine packet transform table only for a time splitting level utilizing the bell window functions.

13. The computer program of claim 10 wherein the instructions for causing the computer to perform the best basis analysis includes instructions for causing the computer to:

build a statistics tree for the pre-split subframes;

generate an extended statistics tree from the statistics tree; and perform the best basis analysis to determine an extended best basis tree from the extended statistics tree.

14. The computer program of claim 13 wherein the instructions for causing the computer to determine the optimal transform coefficients includes instructions for causing the computer to determine the optimal transform coefficients from the extended best basis tree.

15. A computer program, residing on a computer-readable medium, for performing an inverse adaptive cosine packet transform, the computer program comprising instructions for causing a computer to:

receive a bit stream;

generate cosine packet coefficients based on the bit stream;

access bell window functions;

join an extended basis tree into a combined basis tree;

synthesize a time-domain signal from cosine packet coefficients based on the bell window functions and the combined basis tree; and generate audio data based on the time-domain signal.

16. The computer program of claim 15 further including instructions for causing the computer to apply the inverse adaptive cosine packet transform to signal coefficients to generate a time-domain reconstructed signal waveform.

17. The computer program of claim 15 wherein the instructions for causing a computer to access bell window functions include instructions for causing a computer to calculate bell window functions.

18. The computer program of claim 15 wherein the cosine packet coefficients include optimal cosine packet coefficients.

19. The computer program of claim 15 wherein the extended basis tree includes an extended best basis tree and the combined basis tree includes a combined best basis tree.

20. A system for performing an adaptive cosine packet transform, including: means for receiving audio data means for calculating bell window functions;

means for calculating a cosine packet transform table for at least one time splitting level utilizing the bell window functions; level means for applying the bell window functions to the audio data to create at least one time splitting level;

means for determining whether a pre-split at the time splitting level is needed for a current frame;

means for recalculating the cosine packet transform table at selected levels depending on the pre-split determination;

means for building a statistics tree for only the selected levels;

means for generating an extended statistics tree from the statistics tree;

means for performing a best basis analysis to determine an extended best basis tree from the extended statistics tree; and means for determining optimal transform coefficients from the extended best basis tree.

21. The system claim 20 further including:

means for determining how to perform the pre-split for the current cosine packet transform frame to form the pre-split subframes; and means for performing the pre-split for the current cosine packet transform frame to form the pre-split subframes.

22. A system for performing an adaptive cosine packet transform, including: means for receiving audio data means for determining whether a pre-split is needed for a current cosine packet transform frame based on the audio data to form pre-split subframes;

means for applying a cosine packet transform to the pre-split subframes based on the determination;

means for performing a best basis analysis; and means for determining optimal transform coefficients.

23. The system of claim 22 further including:

means for determining how to perform the pre-split for the current cosine packet transform frame to form the pre-split subframes; and means for performing the pre-split for the current cosine packet transform frame to form the pre-split subframes.

24. The system of claim 22 further including:

means for calculating bell window functions; and means for calculating a cosine packet transform table only for a time splitting level utilizing the bell window functions.

25. The system of claim 22 wherein the means for performing the best basis analysis includes:

means for building a statistics tree for the pre-split subframes;

means for generating an extended statistics tree from the statistics tree; and means for performing the best basis analysis to determine an extended best basis tree from the extended statistics tree.

26. The system of claim 25 wherein the means for determining the optimal transform coefficients includes means for determining the optimal transform coefficients from the extended best basis tree.

27. A system for performing an inverse adaptive cosine packet transform, including:

means for receiving a bit stream;

means for generating cosine packet coefficients based on the bit stream;

means for accessing bell window functions;

means for joining an extended basis tree into a combined basis tree;

means for synthesizing a time-domain signal from cosine packet coefficients based on the bell window functions and the combined basis tree; and means for generating audio data based on the time-domain signal.

28. The system of claim 27 further including means for applying the inverse adaptive cosine packet transform to signal coefficients to generate a time-domain reconstructed signal waveform.

29. The system of claim 27 wherein accessing bell window functions includes calculating bell window functions.

30. The system of claim 27 wherein the cosine packet coefficients include optimal cosine packet coefficients.

31. The system of claim 27 wherein the extended basis tree includes an extended best basis tree and the combined basis tree includes a combined best basis tree.

32. A method for performing an inverse adaptive cosine packet transform, including:

receiving a bit stream;

generating cosine packet coefficients based on the bit stream;

accessing bell window functions;

joining an extended basis tree into a combined basis tree;

synthesizing a time-domain signal from cosine packet coefficients based on the bell window functions and the combined basis tree; and generating audio data based on the time-domain signal.

33. The method of claim 32 further including applying the inverse adaptive cosine packet transform to signal coefficients to generate a time-domain reconstructed signal waveform.

34. The method of claim 32 wherein accessing bell window functions includes calculating bell window functions.

35. The method of claim 32 wherein the cosine packet coefficients include optimal cosine packet coefficients.

36. The method of claim 32 wherein the extended basis tree includes an extended best basis tree and the combined basis tree includes a combined best basis tree.

* * * * *